US010753583B1

(12) United States Patent
Kay et al.

(10) Patent No.: US 10,753,583 B1
(45) Date of Patent: Aug. 25, 2020

(54) ANGLED LED STRIP CONNECTOR

(71) Applicant: PureEdge Lighting LLC, Chicago, IL (US)

(72) Inventors: Gregory L. Kay, Chicago, IL (US); James E. O'Shea, Chicago, IL (US)

(73) Assignee: PureEdge Lighting LLC, Chicago, IL (US)

( * ) Notice: Subject to any disclaimer, the term of this patent is extended or adjusted under 35 U.S.C. 154(b) by 0 days.

(21) Appl. No.: 16/285,967

(22) Filed: Feb. 26, 2019

(51) Int. Cl.

| | |
|---|---|
| ***F21V 19/00*** | (2006.01) |
| ***F21K 9/20*** | (2016.01) |
| ***F21K 9/65*** | (2016.01) |
| ***F21S 4/20*** | (2016.01) |

(52) U.S. Cl.
CPC ..... *F21V 19/001* (2013.01); *F21K 9/20* (2016.08); *F21K 9/65* (2016.08); *F21S 4/20* (2016.01)

(58) Field of Classification Search
CPC .. F21K 9/65; F21K 9/20; F21V 19/001; F21S 4/20
See application file for complete search history.

(56) References Cited

U.S. PATENT DOCUMENTS

| | | | | |
|---|---|---|---|---|
| 2013/0107528 | A1* | 5/2013 | Boyer | F21S 8/086 362/243 |
| 2013/0208476 | A1* | 8/2013 | Erhard | F21V 17/18 362/249.02 |
| 2016/0208987 | A1* | 7/2016 | McGowan | H05K 3/12 |
| 2018/0135810 | A1* | 5/2018 | Lin | F21K 9/237 |
| 2018/0135841 | A1* | 5/2018 | Yonezawa | G02F 1/133603 |

* cited by examiner

*Primary Examiner* — Kevin Quarterman
(74) *Attorney, Agent, or Firm* — Bishop, Diehl & Lee, Ltd.

(57) ABSTRACT

An angled connector which allows connection between two LED lighting strips without the creation of an undesirable dark gap at connecting corners. The angled connector has a plurality of terminal pairs arranged such that when two LED light strips are connected, a distance between an end LED on one strip and an end LED on the other strip is approximately the same as a distance between adjacent equally-spaced LEDs on surfaces of the two strips. Used in a lighting fixture, a non-linear light source is retained within a housing having an opening through which light from LEDs can be directed. At least first and second adjacent LED light strips are connected at an angle to one another and a distance between end LEDs is approximately the same as a distance between equally-spaced LEDs on the surface of both the first and second LED strips. This configuration eliminates dark gaps at the corners of the fixture.

8 Claims, 6 Drawing Sheets

FIG. 2A (*prior art*)

FIG. 2B (*prior art*)

ANGLED LED STRIP CONNECTOR

TECHNICAL FIELD OF THE INVENTION

The present invention relates to lighting fixtures. More specifically, the invention relates to lighting fixtures using LED strips.

BACKGROUND OF THE INVENTION

An LED strip light (also known as LED tape or ribbon light) is a flexible circuit board with an adhesive backing and populated by surface mounted light-emitting diodes (SMD LEDs) and other components. Traditionally, LED strip lights have been used solely in accent lighting, backlighting, task lighting, and decorative lighting applications. However, a significant increase in luminous-efficacy—a measure of how well a light source produces visible light (lumens/watt)—and higher-power SMDs have allowed LED strip lights to be used in applications such as high brightness task lighting, fluorescent and halogen lighting fixture replacements, indirect lighting applications, manufacturing processes lighting, set and costume design, and even for growing plants. The ease of use of LED lighting strips has boosted the creativity of lighting designers and opened the door for the creation of many new and different lighting fixtures and lighting designs.

The linear strip of SMD LEDs does have some drawbacks. While the strips can be easily connected along a straight line, forming angled connections has been problematic. As shown in FIG. 1, a solder-less connector can be used to connect two LED light strips at a 90° angle. This connector allows for the creation of a square lighting fixture. Obviously, the angle of the connector can vary to create other polygonal shapes. However, as shown in FIG. 2, the connector creates a "dark gap" at each corner which detracts from the fixtures aesthetics and impacts functionality.

Further, the cost of using and concealing a plurality of these connectors in a lighting fixture adds significant costs. In a field where customized lighting displays are already costly, "dark gaps" are not a welcomed feature.

Until the invention of the present application, these and other problems in the prior art went either unnoticed or unsolved by those skilled in the art. The present invention provides an angled connector for LED lighting strips which functions with the associated device without sacrificing portability, design, style or affordability.

SUMMARY OF THE INVENTION

There is disclosed herein an improved LED light strip connector which avoids the disadvantages of prior devices while affording additional structural and operating advantages. A lighting fixture made using the improved connectors is also set forth.

Generally speaking, the connector comprises an electrical insulator pad, and a plurality of solder-less connector terminal pairs arranged on the insulator pad. The terminal pairs are arranged such that when two LED light strips are connected, a distance between an end LED on the first strip and an end LED on the second strip is approximately the same as a distance between adjacent equally-spaced LEDs on the surface of both the first and second LED strips.

As to a lighting fixture, the device is comprised of at least first and second LED light strips having a plurality of LEDs equally-spaced a distance on an upper surface, and at least a first solder-less connector for connecting the first and second LED light strips together at an angle to form a non-linear light source. The non-linear light source is retained within a housing having an opening through which light from LEDs can be directed. A transparent lens covers the opening and at least first and second adjacent LED light strips are at an angle to one another and a distance between an end LED on the first adjacent LED light strip when connected to a first solder-less connector and an end LED on the second adjacent LED light strip when connected to the first solder-less connector is approximately the same as a distance between equally-spaced LEDs on the surface of both the first and second LED strips. This configuration eliminates dark gaps at the corners of the fixture.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
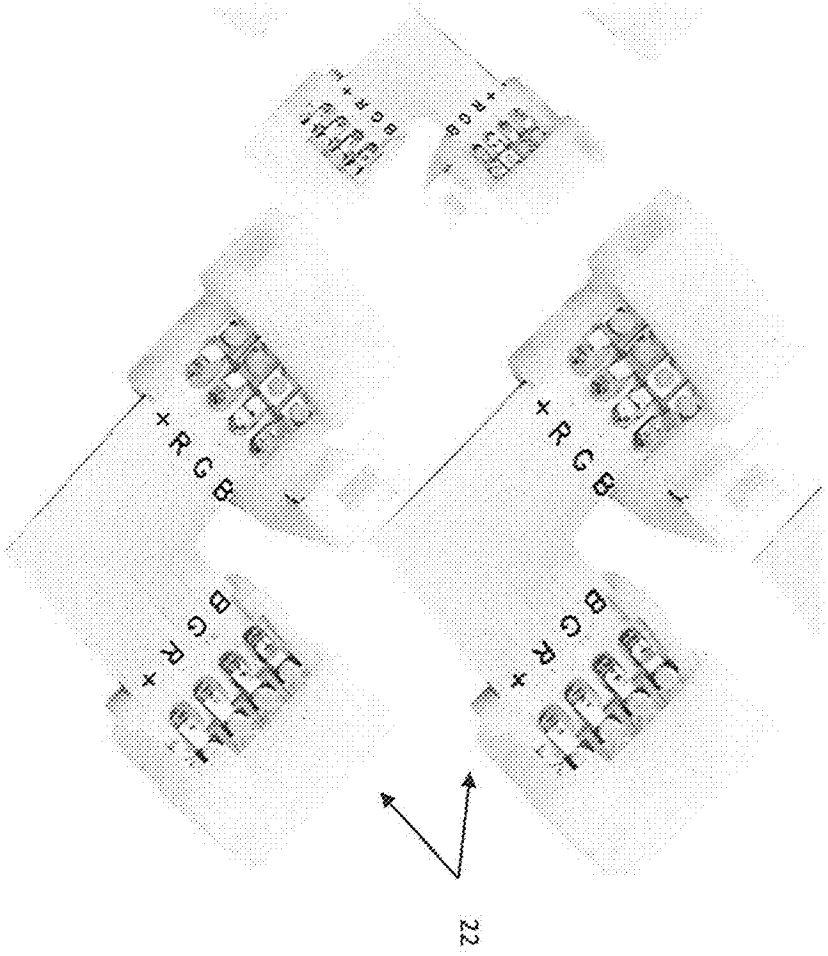
FIG.1 (prior art)
FIG. 1 is a perspective view of a prior art angled connector for LED light strips.
Figure 2:
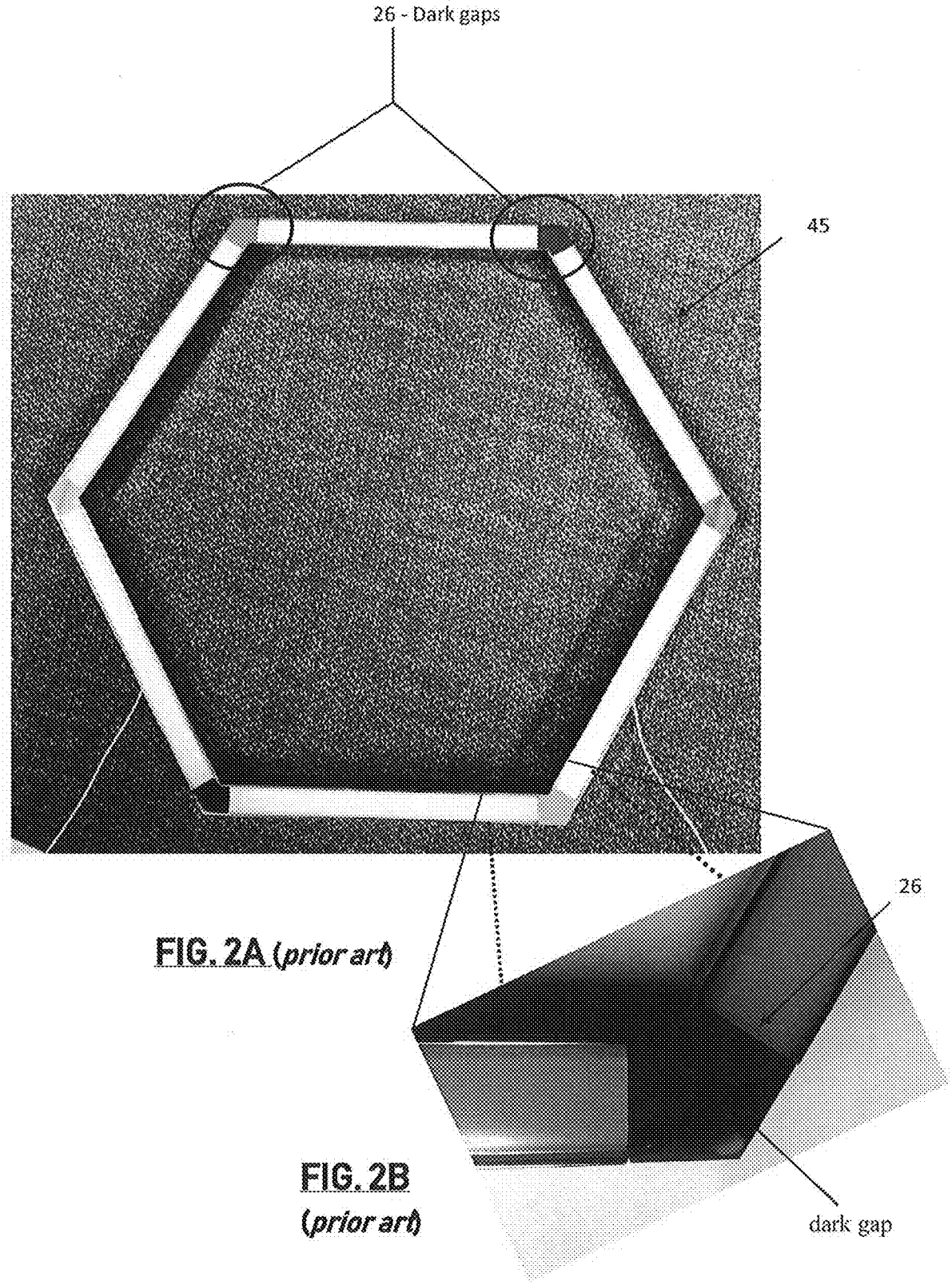
FIG. 2A is a top view of a hexagonal lighting fixture made with prior art angled connectors for LED light strips.
FIG. 2B is a close-up of a corner of the lighting fixture of FIG. 2A showing a dark gap.
Figure 3:
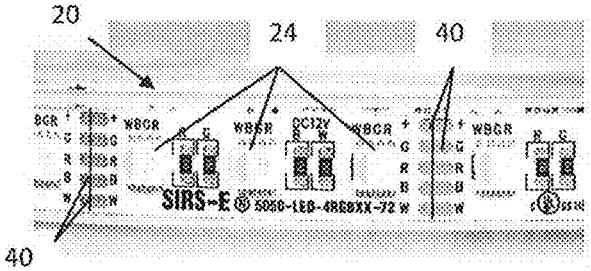
FIG. 3 (prior art)
FIG. 3 is a section of an LED lighting strip.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Figure 4:
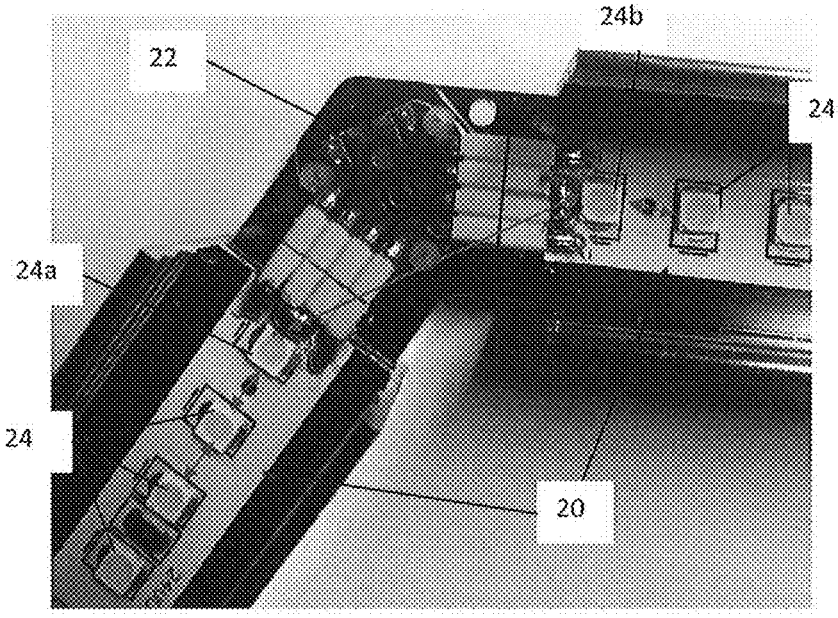
FIG. 4 (prior art)
FIG. 4 is a cut-away view of the corner shown in FIG. 2B with arrows used to indicate a distance between adjacent LEDs.

Referring to FIGS. 1-4, the problem of prior art devices can be more readily understood. As shown, when LED light strips 20 are to be connected at an angle to one another, a problem is created in the corners. Specifically, the prior art angled connector 22 creates too much distance between end LEDs 24*a* and 24*b* on connecting strips 20. The distance between end LEDs 24*a* and 24*b* on connected strips 20 can be at least three times the distance between adjacent LEDs on the strips 20—also known as "pitch". The double arrows of FIG. 4 illustrate the comparative pitch or distances between the different adjacent LEDs. For the most even lighting, the LED pitch is low—i.e., LEDs are closer together. The result of a greater LED pitch creates what is known as "spotting", which is undesirable. Likewise, a large space between end LEDs 24*a* and 24*b* results in a "dark gap" at each angled connection or corner 26. These "dark gaps" are also undesirable as they detract from the aesthetics of the light fixture 45, as shown in FIG. 2*a*.

Referring to FIGS. 5-9, there are illustrated embodiments of an angled LED light strip connector, generally designated by the numeral 10. The two particular illustrated connectors 10 are for 60° and 90° angled connections, but connector angles can be from 5° to 90°. Further, while all the embodiments illustrated are directed to closed geometric shapes (e.g., hexagon, octagon, etc.), it should be understood that the principles of the invention can be more broadly applied any lighting fixture requiring an angled connection between LED light strips.

Generally speaking, the lighting fixture 12 of the present invention is comprised of a plurality of LED light strips 20, each light strip having a plurality of LEDs 24 equally-spaced a distance on an upper surface, angled strip connectors 10, a housing 32, a cover (preferably transparent or semi-transparent) 34 to allow light to pass, and wiring (not shown) to bring the necessary electric current from a source to power the lighting fixture 12.

Such light strips 20 are well-known in the art, being comprised of a substrate 50 with a plurality of equally-spaced LEDs 24 and other components electrically connected in a linear fashion. The strips 20 can be cut to almost any length leaving end contacts 40 (FIG. 3) for connection to a power source (not shown). The angled connector 10 connects consecutive LED lighting strips 20 at an angle to one another. The connector 10 is preferably comprised of at least two pair of solder-less terminal pairs 30 which are used to connect directly to the end contacts 40 (FIG. 3) of the LED lighting strips 20 to form a non-linear light source.

A housing 32 is used to retain, protect, and conceal the non-linear light source, while allowing light to pass through an opening 36. A lens covering 34, preferably transparent or semi-transparent, may be used to cover the opening 36. The terminal pairs 30 are positioned on the substrate such that adjacent LED light strips 20*a* and 20*b* are at an angle to one another and a distance between an end LED 24*a* on a first adjacent LED light strip 20*a* and an end LED 24*b* on a second adjacent LED light strip 20*b* is in the range of about 0.25 to about 2 times the distance between equally-spaced LEDs on the surface of both the first and second LED strips.

Exemplary embodiments of the subject angled connector and lighting fixtures are described below with reference to the relevant drawing figures.

Figure 5A:
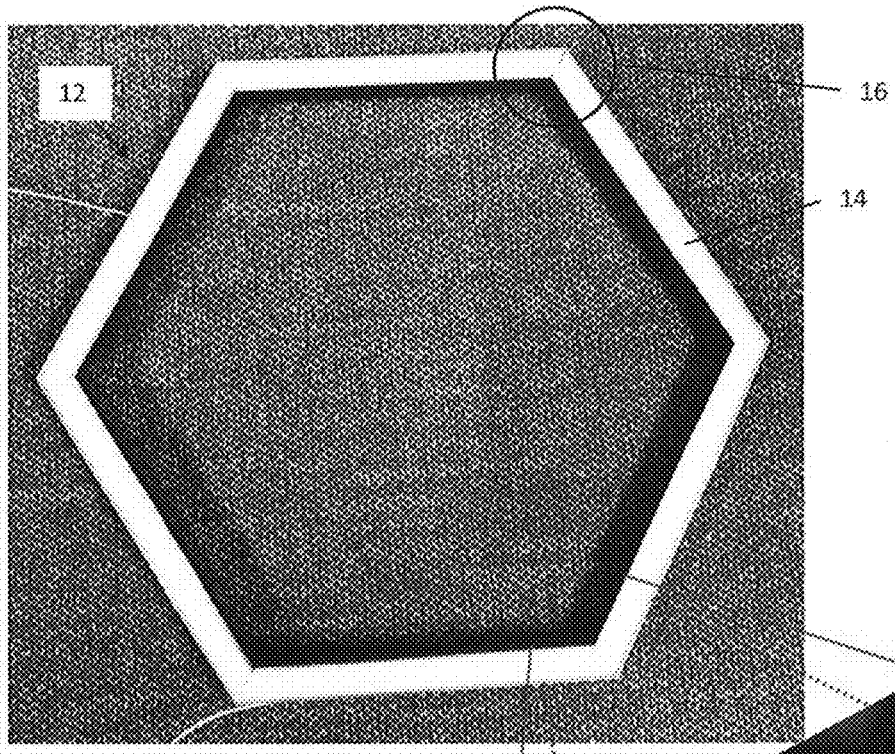
FIG. 5A is a top view of a hexagonal lighting fixture made with an embodiment of angled connectors of the present invention.
Figure 5B:
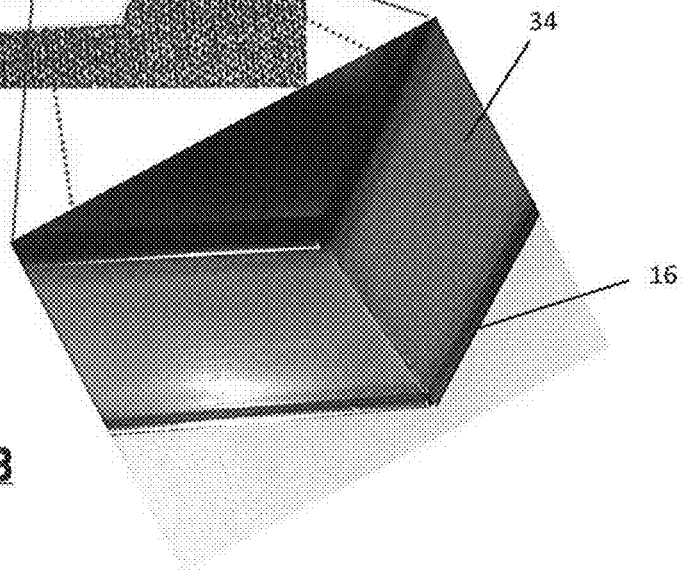
FIG. 5B is a close-up view of a corner of the lighting fixture of 5A, without a dark gap.

As can be seen in FIGS. 5A and 5B, an octagon lighting fixture 12 is shown with a continuous illuminating surface 14. Even the corners 16, as shown more clearly in the close up of FIG. 5B, are illuminated without the detracting "dark gaps" of the prior art.

Figure 6:
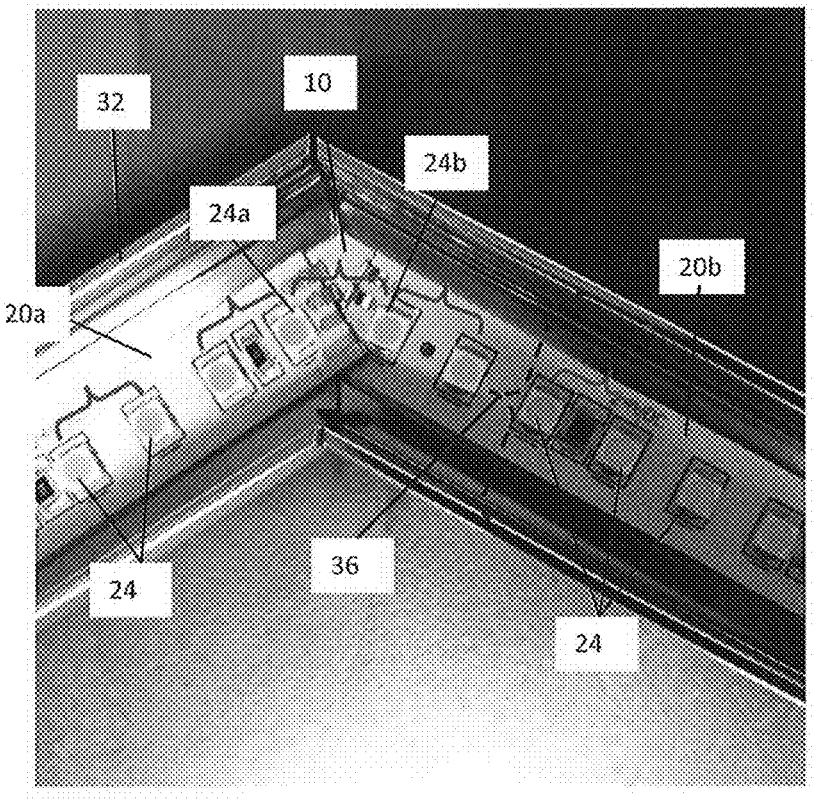
FIG. 6 is a cutaway view of the corner of FIG. 5B with brackets used to show the distance between adjacent LEDs.
Figure 7:
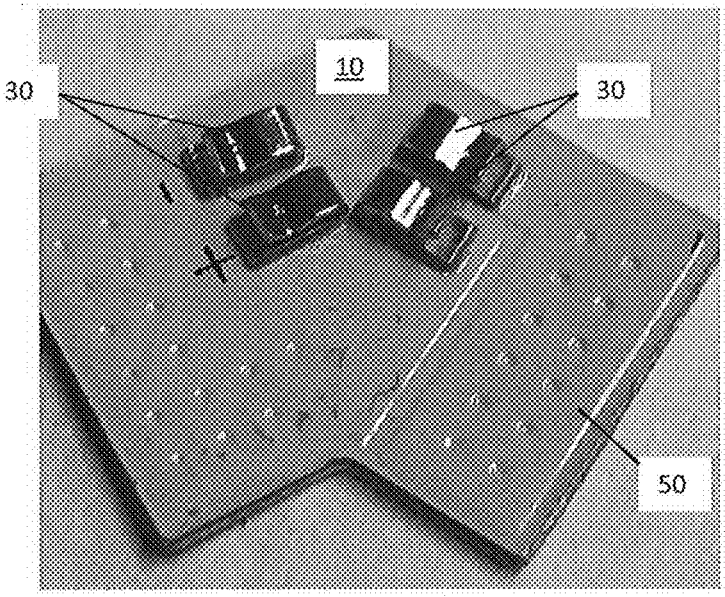
FIG. 7 is a top view of an embodiment of a 60° angled connector as used in the lighting fixture of FIG. 5A.

FIGS. 6 and 7 illustrate an embodiment of the 60° connector 10. The positioning of LED terminal pairs 30 allow two LED lighting strips 20*a* and 20*b* to be more closely connected. The result, as illustrated by the brackets of FIG. 7, is that the end LEDs 24*a* and 24*b* of each strip are approximately the same distance apart as adjacent LEDs on each strip. This spacing creates the necessary even lighting throughout the lighting fixture 12 of FIG. 5A.

Figure 8:
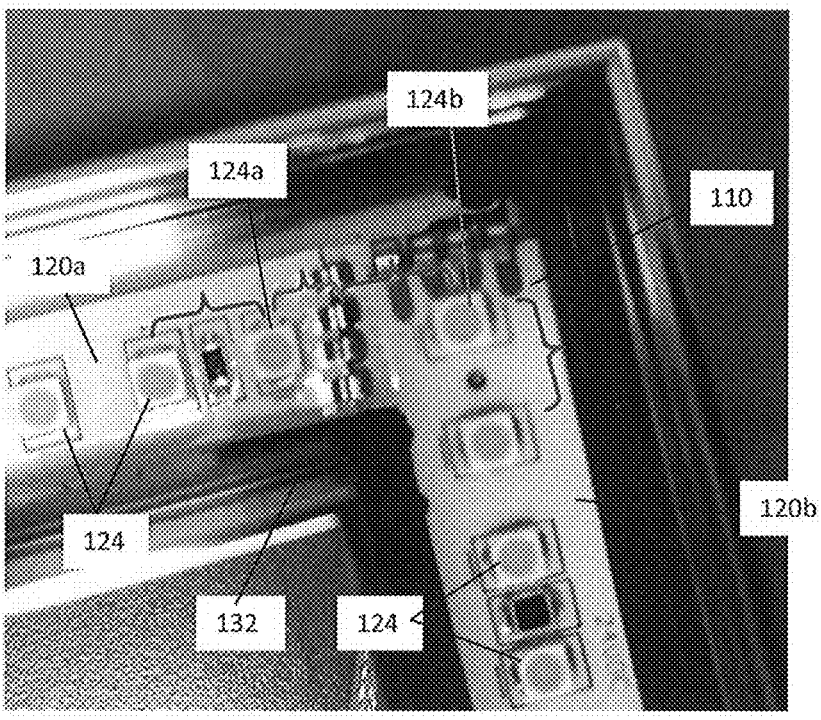
FIG. 8 is another cutaway view of a lighting fixture corner (90° ) using an embodiment of an angled LED light strip connector of the present invention, including brackets to indicate distance between adjacent LEDs.
Figure 9:
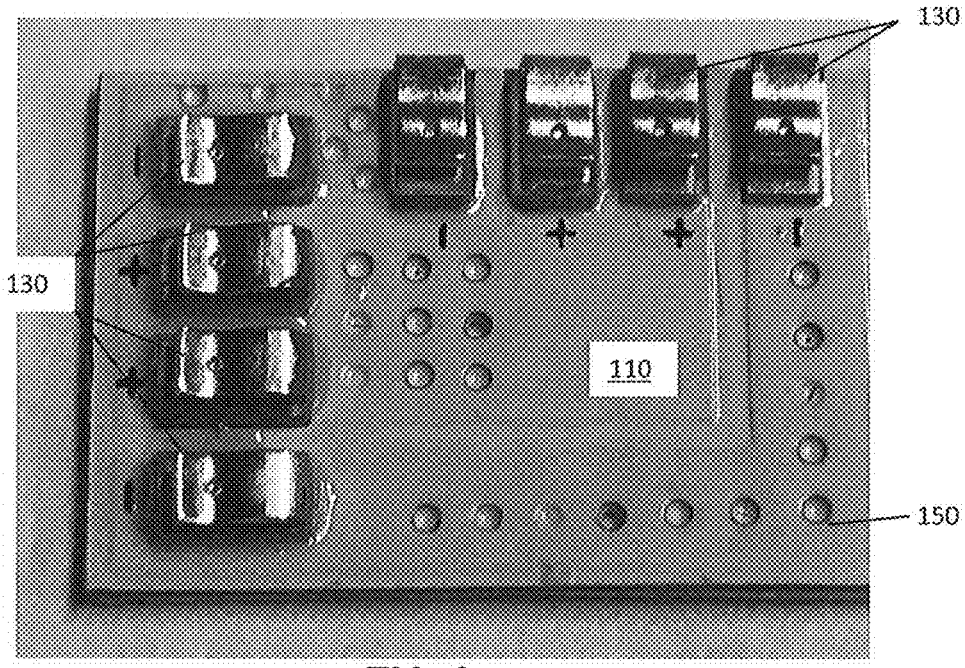
FIG. 9 is a top view of an embodiment of a 90° angled connector as used in the corner illustrated in FIG. 8.

Similarly, FIG. 8 illustrates a connection between two LED lighting strips 120*a* and 120*b* using a 90° connector 110. An embodiment of the connector 110 is shown in FIG. 9. Note that the positioning of the terminal pairs 130 on the substrate 150 are arranged differently than those of the 60° connector described above. Nonetheless, the end LEDs 124*a* and 124*b* of the two LED lighting strips 120*a* and 120*b* are separated a distance of no more than about 1.5 times the distance between adjacent LEDs on the two strips. Preferably, the distance between end LEDs is in the range of about 0.25 to 2 times the distance of adjacent LEDs on the connected strips. More preferably, the gap is in the range of about 0.5 to 1.5 times the distance, and most preferably the gap is in the range of about 0.75 to 1.25 times the distance.

In a preferred embodiment, the terminal pairs 30/130 are made from high-conductivity beryllium copper of about 0.012 inch thickness with a 1-3 micrometer (gm) gold plate over a 150-350 micrometer (gm) electroless nickel plate. The substrate 50/150 is preferably a commercial grade thermally-conductive insulator pad, such as the Cho-Therm T441 product made by Parker Hannifin Corp. Chomerics Division in Woburn, MA.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An angled connector for connecting first and second LED lighting strips together at an angle, the first and second LED strips each having a plurality of LEDs equally-spaced a distance on an upper surface, the connector comprising:

an electrical insulator pad;

a plurality of solder-less connector terminal pairs arranged on the insulator pad such that a distance between an end LED on the first strip when connected to a first pair of solder-less connector terminal pairs and an end LED on the second strip when connected to a second pair of solder-less connector terminal pairs is in the range of about 0.25 to about 2 times the distance between the equally-spaced LEDs on the surface of both the first and second LED strips.

2. The angled connector of claim 1, wherein the distance between an end LED on the first strip when connected to a first pair of solder-less connector terminal pairs and an end LED on the second strip when connected to a second pair of solder-less connector terminal pairs is in the range of about 0.5 to about 1.5 times the distance between the equally-spaced LEDs on the surface of both the first and second LED strips.

3. The angled connector of claim 2, wherein the distance between an end LED on the first strip when connected to a first pair of solder-less connector terminal pairs and an end LED on the second strip when connected to a second pair of solder-less connector terminal pairs is in the range of about 0.75 to about 1.25 times the distance between the equally-spaced LEDs on the surface of both the first and second LED strips.

4. The angled connector of claim 1, wherein the terminal pairs are arranged to connect the first and second LED lighting strips at a 60° angle.

5. The angled connector of claim 4, wherein the number of solder-less connector terminal pairs is two.

6. The angled connector of claim 1, wherein the terminal pairs are arranged to connect the first and second LED lighting strips at a 90° angle.

7. The angled connector of claim 1, wherein the terminal pairs are arranged to connect the first and second LED lighting strips at an angle in the range of from about 5° to 90°.

8. The angled connector of claim 1, wherein the number of solder-less connector terminal pairs is four.

* * * * *